US009395098B2

(12) United States Patent
Enke et al.

(10) Patent No.: US 9,395,098 B2
(45) Date of Patent: Jul. 19, 2016

(54) DAMPER BLADE SEAL SYSTEM

(75) Inventors: Joseph Dean Enke, Kansas City, MO (US); Edward N. Koop, Olathe, KS (US)

(73) Assignee: Ruskin Company, Grandview, MO (US)

( * ) Notice: Subject to any disclaimer, the term of this patent is extended or adjusted under 35 U.S.C. 154(b) by 1007 days.

(21) Appl. No.: 13/542,837

(22) Filed: Jul. 6, 2012

(65) Prior Publication Data

US 2014/0008561 A1 Jan. 9, 2014

(51) Int. Cl.
*F24F 13/14* (2006.01)
*F24F 13/15* (2006.01)

(52) U.S. Cl.
CPC ..... *F24F 13/14* (2013.01); *F24F 13/1406* (2013.01); *F24F 13/1413* (2013.01)

(58) Field of Classification Search
CPC .... F24F 13/14; F24F 13/1406; F24F 13/1413
USPC ..... 454/339, 335, 336, 359; 49/74.1, 91.1, 49/498.1, 499.1; 137/601.06, 601.12, 137/15.25, 32; 251/361, 306
See application file for complete search history.

(56) References Cited

U.S. PATENT DOCUMENTS 2,683,907 A * 7/1954 Lovasik ..... F16J 15/121 138/106
3,084,715 A * 4/1963 Scharres ..... F16K 1/165 126/285 R
3,366,032 A * 1/1968 Alamprese ..... F24F 13/15 454/278
3,530,783 A * 9/1970 Alamprese ..... F24F 13/00 454/335
3,547,152 A * 12/1970 Hess ..... F24F 13/10 137/601.06
3,746,042 A * 7/1973 Finkel ..... F24F 13/14 137/601.06
3,832,940 A * 9/1974 Hess ..... A62C 2/06 137/601.06
3,885,347 A * 5/1975 Adachi ..... F24F 13/15 137/601.06
4,077,432 A * 3/1978 Herr ..... F16K 1/165 137/246.22
4,256,143 A * 3/1981 Magill ..... F24F 13/15 137/601.06
4,294,283 A * 10/1981 Scharres ..... F16K 1/165 137/599.02
4,545,566 A 10/1985 Kammerer
4,643,081 A * 2/1987 Vicinanza ..... E06B 7/086 137/601.05
5,788,218 A 8/1998 Goldman
6,010,114 A 1/2000 Moore et al.
6,237,630 B1 5/2001 Stone et al.
6,435,211 B2 8/2002 Stone et al.

FOREIGN PATENT DOCUMENTS

DE 29603872 U1 * 3/1996 ..... F24F 13/1406
GB 2203530 A * 10/1988 ..... F24F 13/15

OTHER PUBLICATIONS

Canadian Patent Office; Office Action; Canadian Patent Application No. 2,820,258, Apr. 8, 2015, 5 pages.

* cited by examiner

*Primary Examiner* — Steven B McAllister
*Assistant Examiner* — Frances F Hamilton
(74) *Attorney, Agent, or Firm* — Jackson Walker LLP; Christopher J. Rourk

(57) ABSTRACT

A damper having a first seal and a second seal disposed to cooperatively engage an adjacent first blade end portion and second blade end portion such that a dead air space is created between the adjacent first seal and second seal in a damper closed position, and a first thermal gap and a second thermal gap disposed within said dead air space in the damper closed position.

20 Claims, 4 Drawing Sheets

DAMPER BLADE SEAL SYSTEM

FIELD OF THE INVENTION

The invention relates to a damper blade seal system and more particularly, to a damper having a first seal and a second seal disposed to cooperatively engage an adjacent first blade end portion and second blade end portion such that a dead air space is created between the adjacent first seal and second seal in a damper closed position, and a first thermal gap and a second thermal gap disposed within said dead air space in the damper closed position.

BACKGROUND OF THE INVENTION

HVAC dampers provide a means of controlling air flow through air handling duct systems. Dampers may comprise a single damper blade or multiple damper blades. Damper blades maybe either circular, rectangular or other shape as may suit a designer.

Damper blades require seals to optimize system efficiency. Leakage includes gas flow around the damper blade which can cause volumetric or temperature related system problems.

Seals may comprise a metallic strip which is pressed between the damper blade and an adjacent sealing surface such as a damper frame or body. While effective in many situation such a design offers little in terms of being an effective thermal barrier.

In certain applications there can be a significant temperature differential which can cause loss of heating or cooling energy across the damper, for example, a damper discharging to the exterior of a building during cold or hot conditions. In such conditions the single strip seal is inefficient leading to excessive heating or cooling upstream of the damper, or condensation on the damper which can lead to premature failure.

Representative of the art is U.S. Pat. No. 4,545,566 which discloses metal seals for damper blades, preferably made of sheet metal, as well as the combination of the blade with the metal seal. The damper blade is pivotably mountable and has longitudinally extending edges which are formed to define a groove spaced from and close to the longitudinal edge of the blade and parallel thereto. The metal seal is constituted by a rolled strip of metal formed to include a pair of opposite sides and a bottom defining a U-shaped portion, a hook portion extends inwardly from the free end of one of said sides toward the bottom of the U, and a sealing flap is reversely bent to extend away from the end of the other of said sides. In use, the U-portion of the seal is forced onto the grooved edge until the free end of the hook portion snaps and locks into the groove.

What is needed is a damper a first seal and a second seal disposed to cooperatively engage an adjacent first blade end portion and second blade end portion such that a dead air space is created between the adjacent first seal and second seal in a damper closed position, and a first thermal gap and a second thermal gap disposed within said dead air space in the damper closed position. The present invention meets this need.

SUMMARY OF THE INVENTION

The primary aspect of the invention is to provide a damper having the a first seal and a second seal disposed to cooperatively engage an adjacent first blade end portion and second blade end portion such that a dead air space is created between the adjacent first seal and second seal in a damper closed position, and a first thermal gap and a second thermal gap disposed within said dead air space in the damper closed position.

Other aspects of the invention will be pointed out or made obvious by the following description of the invention and the accompanying drawings.

The invention comprises a damper comprising a frame, a first blade pivotally engaged with the frame, the first blade comprising a first end portion disposed at an obtuse angle $\alpha$ with respect to a first blade axis, the first blade comprising a hollow portion for receiving an insulating material and further comprising a first thermal gap for interrupting a thermally conductive path across the first end portion, a second blade pivotally engaged with the frame, the second blade comprising a second end portion disposed at an obtuse angle $\alpha$ with respect to a second blade axis, the second blade comprising a hollow portion for receiving an insulating material and further comprising a second thermal gap for interrupting a thermally conductive path across the second end portion, a first seal connected to the first end portion of the first blade, a second seal connected to the second end portion of the second blade, the first seal and the second seal disposed to cooperatively engage an adjacent first blade end portion and second blade end portion such that a dead air space is created between the adjacent first seal and second seal in a damper closed position, and the first thermal gap and the second thermal gap disposed within said dead air space in the damper closed position.

BRIEF DESCRIPTION OF THE DRAWINGS

The accompanying drawings, which are incorporated in and form a part of the specification, illustrate preferred embodiments of the present invention, and together with a description, serve to explain the principles of the invention.

DETAILED DESCRIPTION OF THE PREFERRED EMBODIMENT

Figure 1:
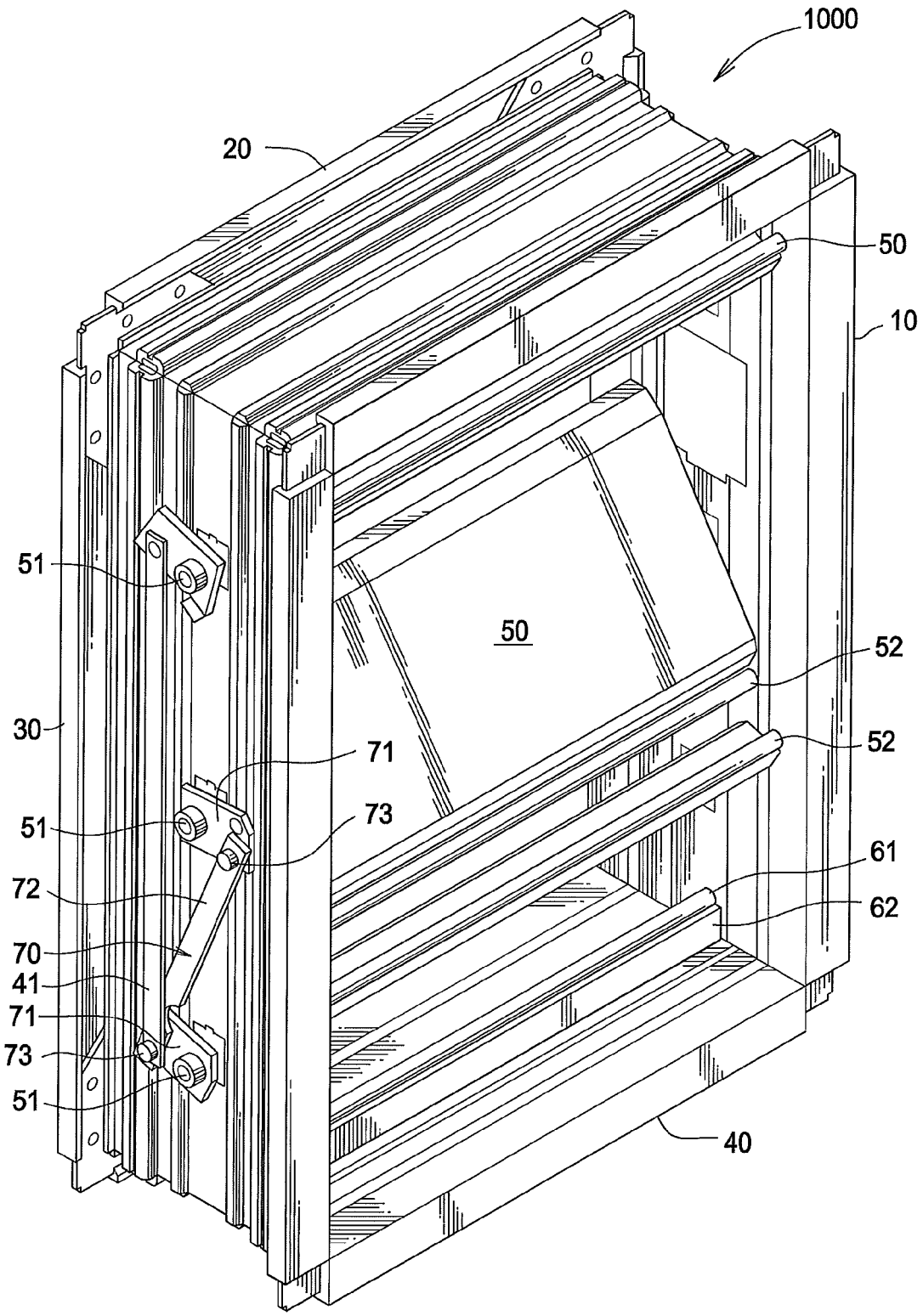
FIG. 1 is a perspective view of a damper with the inventive seal system.

FIG. 1 is a perspective view of a damper with the inventive seal system. The inventive damper 1000 comprises frame members 10, 20, 30, 40. In this embodiment the frame is rectangular. Disposed within the frame are damper blades 50. Each damper blade 50 pivots about an axle 51. Each damper blade is mechanically linked through a linkage which controls a coordinated movement of the damper blades when the damper is in operation. In this embodiment the damper blades pivot in alternating directions, see FIG. 3. In an alternate embodiment the blades 50 rotate in the same direction. The inventive seal system is used on each end of each damper blade. Movement of the damper blades may be automatically or manually performed using an actuator known in the art (not shown). The actuator can be connected to either a linkage or blade axle as may be required by a user.

More particularly, operation of the damper is controlled by linkage 70 that causes blades 50 to operate with a synchronized movement. Linkage 70 comprises a lever 71 mounted on the end of each shaft 51 on the outside of the damper frame 30. Levers 71 (also called rockers or control arms) are connected to one or more tie-bars 41 which tie the control arms 71 of multiple blades together. This arrangement causes the blades to move together in a synchronized fashion. The operating lengths of the control arms 71 are equal in the preferred embodiment. The spacing of pins 73 along the length of the tie-bar 41 is preferably equal to the spacing of the blade axles 51.

When tie-bar 72 causes motion of the control arms 71 the motion is substantially synchronized between the damper blades. However, manufacturing variations may result in differences of the spacing of tie-bar pins 73 and axle 51 holes, and the length of each control arm. This may cause non-synchronized motion resulting in the seals 52 of some blade pairs being properly aligned while other seal pairs may engage at greater or lesser angles from the closed position. The invention compensates for this variation allowing the damper to seal over a wider range of engagement positions.

Figure 2:
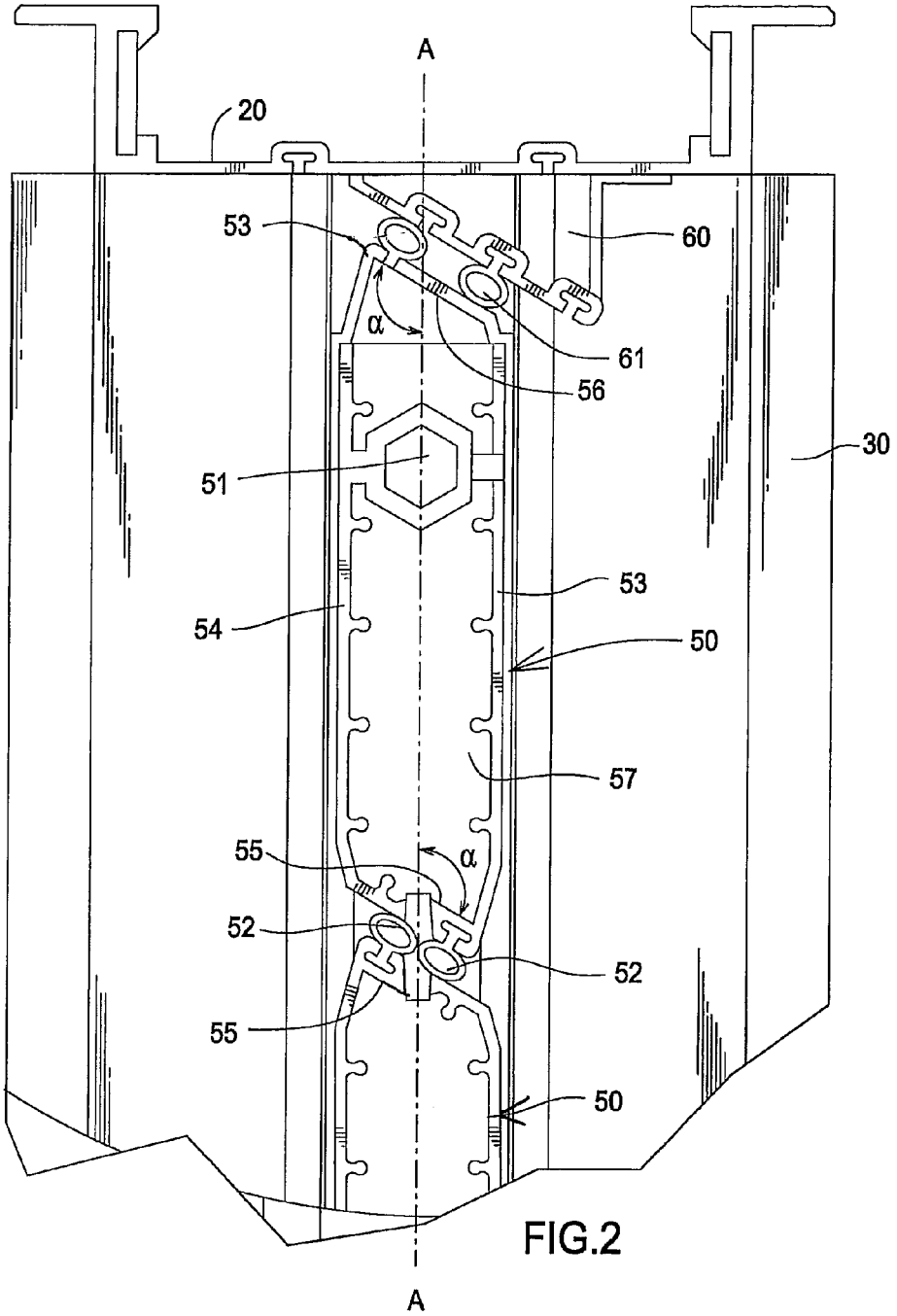
FIG. 2 is a side cross section view of the damper seal system.

FIG. 2 is a side cross section view of the damper seal system. Each blade is hollow and comprises sides 53 and 54. Each end 55, 56 is disposed at an obtuse angle "α" with respect to an axis of the damper blade A-A. Angle α is in the range of 110° to 120°. Ends 55, 56 are substantially parallel in this embodiment.

An end member 60 is attached to a frame member 20 across a width of the damper. A like end member 62 is attached to a frame member 40 across the width of the damper. Each end member 60, 62 provide a means of sealing each damper blade with the damper frame.

Each damper blade 50 comprises a seal 52 on a first end 55 and a seal 53 on a second end 56. A seal 61 is attached to end members 60, 62. Each seal 52, 53, 61 comprises a flexible polymeric material suitable for such service. This can include rubber, polymers or fire resistant materials. Each seal may also comprise a flexible metal suitable to high temperature use and low temperature use. Each seal 52, 53, 61 may be hollow or comprise a solid core. The hollow core embodiment allows for some compression of the seal as the damper is closed. Further the hollow core embodiment provides a further means of insulation since the hollow core of the seal is air filed.

To seal the damper each seal 52 engages cooperating surface 55 on the adjacent damper blade in the closed position. The engagement with the cooperating surface 55 presses on the seal thereby causing a slight deformation of the seal, which optimizes the sealing effect.

Although FIG. 2 shows the blades in optimal alignment in the closed position, the damper seals will allow proper sealing even if the damper blades 50 are not fully closed. For example, if the blades are up to approximately 4.5 degrees under-rotated or over-rotated with respect to each other, both seals 52 will still engage surface 55 as shown to make a proper seal.

Each damper blade 50 in this embodiment is filled with an insulating material such as foam or other suitable insulating material which can be formed within the blade.

Figure 3:
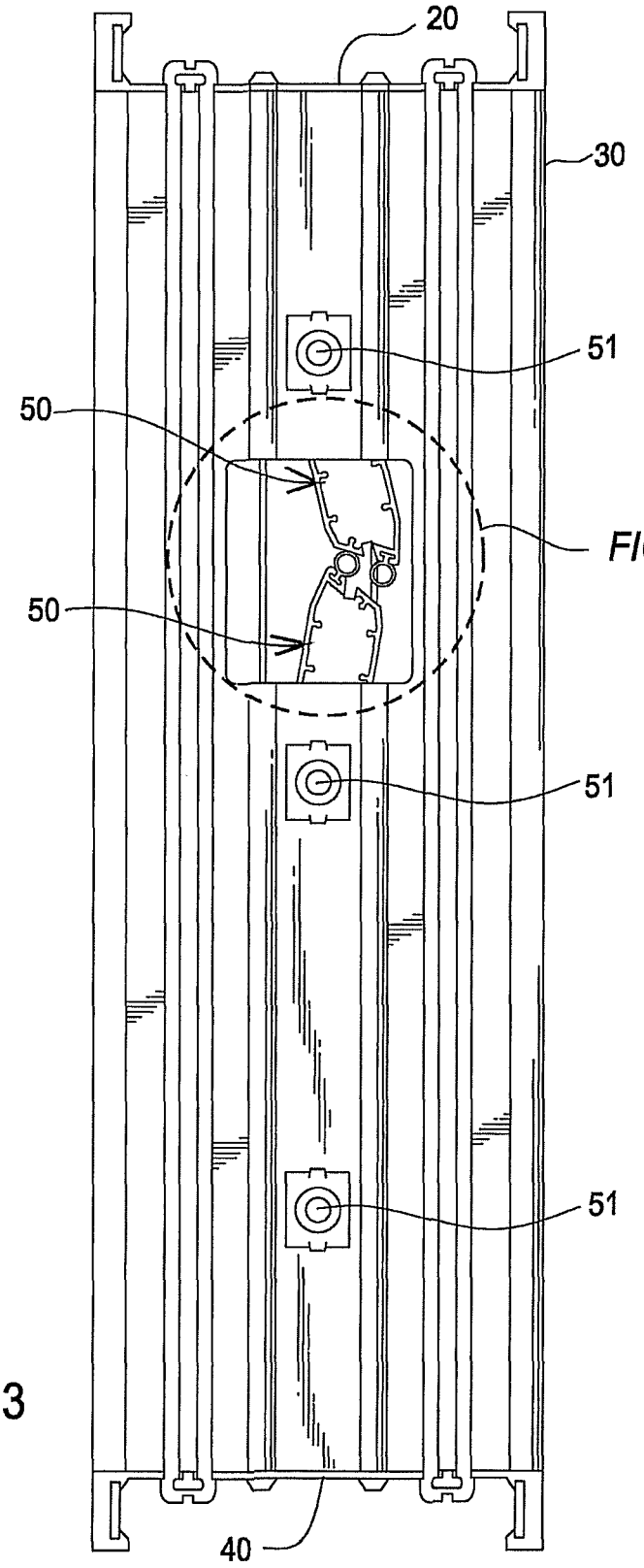
FIG. 3 is a side cross section view of the damper seal system in operation.

FIG. 3 is a side cross section view of the damper seal system in operation. To open the damper, upper damper blade 50 pivots in the counterclockwise direction while the lower damper blade 50 pivots in the clockwise direction. Each blade pivots in a direction opposite that of the adjacent blade. In an alternate embodiment the blades rotate parallel to each other in the same direction. The blades engage to seal as described in FIG. 2 for either the parallel rotation operation or the opposite direction rotation operation.

Figure 4:
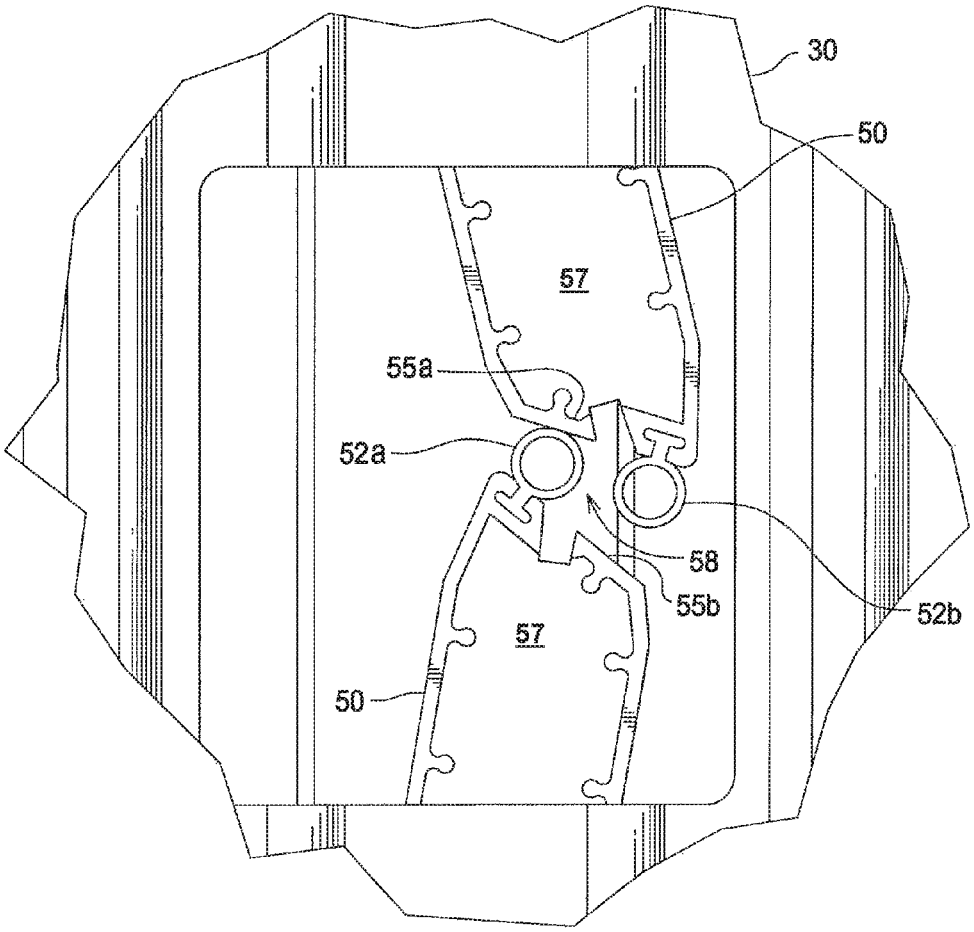
FIG. 4 is a side cross section detail view of the damper seal system.

FIG. 4 is a side cross section detail view of the damper seal system. Each end 55 comprises a thermal break or gap at the boundary of the insulating material 57. Since each blade is typically made of metal, the thermal break breaks the conductive thermal path which may otherwise be available for thermal transmission across the end portion of the damper blade 50. Each thermal gap has a length greater than 50% of the distance between the first seal 52 and the second seal 52.

In the closed position a "dead air" space 58 is created between the adjacent seals 52. The dead air space acts as an insulator. Each thermal break at the boundary of the insulating material 57 on each blade is disposed within the dead air space in the damper closed position.

As the damper begins to close the first seal 52*a* contacts end surface 55*a*. As closing continues first seal 52*a* in effect pivots or rolls upon end surface 55*a*. This progresses until second seal 52*b* comes into contact with end surface 55*b* thereby sealing the damper in the closed position. Seal 52*b* lands on end surface 55*b* without sideways sliding or scraping on end surface 55*b* which minimizes wear on the seal. The rolling nature of the engagement between 52*a* and 55*a* also minimizes wear on the seal thereby extending the operational life of the seal.

The inventive device comprises a damper comprising a frame, a first blade pivotally engaged with the frame, the first blade comprising a first end portion disposed at an obtuse angle α with respect to a first blade axis, the first blade comprising a hollow portion for receiving an insulating material and further comprising a first thermal gap for interrupting a thermally conductive path across the first end portion, a second blade pivotally engaged with the frame, the second blade comprising a second end portion disposed at an obtuse angle α with respect to a second blade axis, the second blade comprising a hollow portion for receiving an insulating material and further comprising a second thermal gap for interrupting a thermally conductive path across the second end portion, a first seal connected to the first end portion of the first blade, a second seal connected to the second end portion of the second blade, the first seal and the second seal disposed to cooperatively engage an adjacent first blade end portion and second blade end portion such that a dead air space is created between the adjacent first seal and second seal in a damper closed position, and the first thermal gap and the second thermal gap disposed within said dead air space in the damper closed position.

Although a form of the invention has been described herein, it will be obvious to those skilled in the art that variations may be made in the construction and relation of parts without departing from the spirit and scope of the invention described herein.

We claim:

1. A damper comprising:

a frame;

a first blade pivotally engaged with the frame, the first blade comprising a first end portion disposed at an obtuse angle α with respect to a first blade axis, the first blade comprising a hollow portion for receiving an insulating material and further comprising a first thermal gap for interrupting a thermally conductive path across the first end portion;

a second blade pivotally engaged with the frame, the second blade comprising a second end portion disposed at an obtuse angle α with respect to a second blade axis, the second blade comprising a hollow portion for receiving an insulating material and further comprising a second thermal gap for interrupting a thermally conductive path across the second end portion;

a first seal connected to the first end portion of the first blade;

a second seal connected to the second end portion of the second blade;

the first seal and the second seal disposed to cooperatively engage an adjacent first blade end portion and second blade end portion such that a dead air space is created between the adjacent first seal and second seal in a damper closed position; and the first thermal gap and the second thermal gap disposed within said dead air space in the damper closed position.

2. The damper as in claim 1, wherein the angle α is in the range of approximately 110° to 120°.

3. The damper as in claim 1, wherein the first thermal gap has a length greater than 50% of a distance between the first seal and the second seal.

4. The damper as in claim 1, wherein the first seal is hollow.

5. The damper as in claim 4, wherein the second seal is hollow.

6. The damper as in claim 1, wherein the first blade rotates in a direction opposite of the second blade during operation.

7. The damper as in claim 1, wherein the insulating material is foam.

8. The damper as in claim 1, wherein the first seal has a rolling engagement with the second blade end portion as the damper is closed.

9. The damper as in claim 1, wherein the first blade rotates in the same direction as the second blade during operation.

10. A damper comprising:

a frame;

a first blade pivotally engaged with the frame, the first blade comprising a first end portion disposed at an obtuse angle α with respect to a first blade axis, the first blade comprising a hollow portion for receiving an insulating material and further comprising a first thermal gap for interrupting a thermally conductive path across the first end portion;

a second blade pivotally engaged with the frame, the second blade comprising a second end portion disposed at an obtuse angle α with respect to a second blade axis, the second blade comprising a hollow portion for receiving an insulating material and further comprising a second thermal gap for interrupting a thermally conductive path across the second end portion;

a first seal connected to the first end portion of the first blade;

a second seal connected to the second end portion of the second blade;

the first seal and the second seal disposed to cooperatively engage an adjacent first blade end portion and second blade end portion with the damper in the closed position; and a dead air space disposed between the first seal and second seal with the damper in the closed position.

11. The damper as in claim 10, wherein the first seal has a rolling engagement with the second blade end portion as the damper is closed.

12. The damper as in claim 10, wherein the first thermal gap is disposed between the first seal and the second seal with the damper in the closed position.

13. The damper as in claim 12, wherein the second thermal gap is disposed between the first seal and the second seal with the damper in the closed position.

14. A damper comprising:

a frame;

a first blade pivotally engaged with the frame, the first blade comprising a first end portion disposed at an obtuse angle α with respect to a first blade axis, the first blade comprising a hollow portion for receiving an insulating material and further comprising a first thermal gap for interrupting a thermally conductive path across the first end portion;

a second blade pivotally engaged with the frame, the second blade comprising a second end portion disposed at an obtuse angle α with respect to a second blade axis, the second blade comprising a hollow portion for receiving an insulating material and further comprising a second thermal gap for interrupting a thermally conductive path across the second end portion;

a first hollow seal connected to the first end portion of the first blade;

a second seal connected to the second end portion of the second blade;

the first hollow seal and the second seal disposed to cooperatively engage an adjacent first blade end portion and second blade end portion such that a dead air space is created between the adjacent first hollow seal and second seal in a damper closed position;

the first thermal gap and the second thermal gap disposed within said dead air space in the damper closed position; and wherein the first hollow seal has a rolling engagement with the second blade end portion as the damper is closed.

15. The damper as in claim 14, wherein the angle α is in the range of approximately 110° to 120°.

16. The damper as in claim 14, wherein the first thermal gap has a length greater than 50% of a distance between the first hollow seal and the second seal.

17. The damper as in claim 14, wherein the second seal is hollow.

18. The damper as in claim 14, wherein the first blade rotates in a direction opposite of the second blade during operation.

19. The damper as in claim 14, wherein the insulating material is foam.

20. The damper as in claim 14, wherein the first blade rotates in the same direction as the second blade during operation.

* * * * *